United States Patent [19]

Koenig, Jr.

[11] 4,343,970

[45] Aug. 10, 1982

[54] SIGNALING SYSTEM

[75] Inventor: Walter Koenig, Jr., Clifton, N.J.

[73] Assignee: Bell Telephone Laboratories, Incorporated, Murray Hill, N.J.

[21] Appl. No.: 337,749

[22] Filed: Feb. 19, 1953

[51] Int. Cl.[3] ..... H04K 1/06

[52] U.S. Cl. ..... 179/1.5 R; 179/1.5 S; 178/22.04

[58] Field of Search ..... 178/22, 22.04; 179/1.5, 179/1.5 G, 1.5 R, 1.5 S

[56] References Cited

U.S. PATENT DOCUMENTS

| | | | |
|---|---|---|---|
| 487,229 | 11/1892 | Neal . | |
| 1,613,686 | 1/1927 | Vernam . | |
| 1,953,918 | 4/1934 | Bellamy . | |
| 2,098,956 | 11/1937 | Dudley . | |
| 2,139,676 | 12/1938 | Friedman . | |
| 2,272,070 | 2/1942 | Reeves . | |
| 2,401,888 | 6/1946 | Smith . | |
| 2,414,101 | 1/1947 | Hogan et al. . | |
| 2,517,587 | 8/1950 | Mohr . | |
| 2,547,514 | 4/1951 | Zenner . | |
| 2,913,525 | 11/1959 | Larsen | 179/1.5 R |

*Primary Examiner*—Howard A. Birmiel
*Attorney, Agent, or Firm*—J. P. Kearns

EXEMPLARY CLAIM

1. In electrical signaling in which the signal varies in amplitude from instant to instant, and at any one instant has an amplitude equal to one of a limited number of values having a total range in excess of two, means to disguise the signal preparatory to transmission comprising means in each instant to establish for transmission under control of said signal a voltage having with substantially equal probability any one of a like limited number of amplitude values having a total range in excess of two, means to transmit said established voltages, and means at a receiving point to retranslate the transmitted voltages into the clear signal.

5 Claims, 7 Drawing Figures

| |
|---|
| FIG. 1 |
| FIG. 2 |

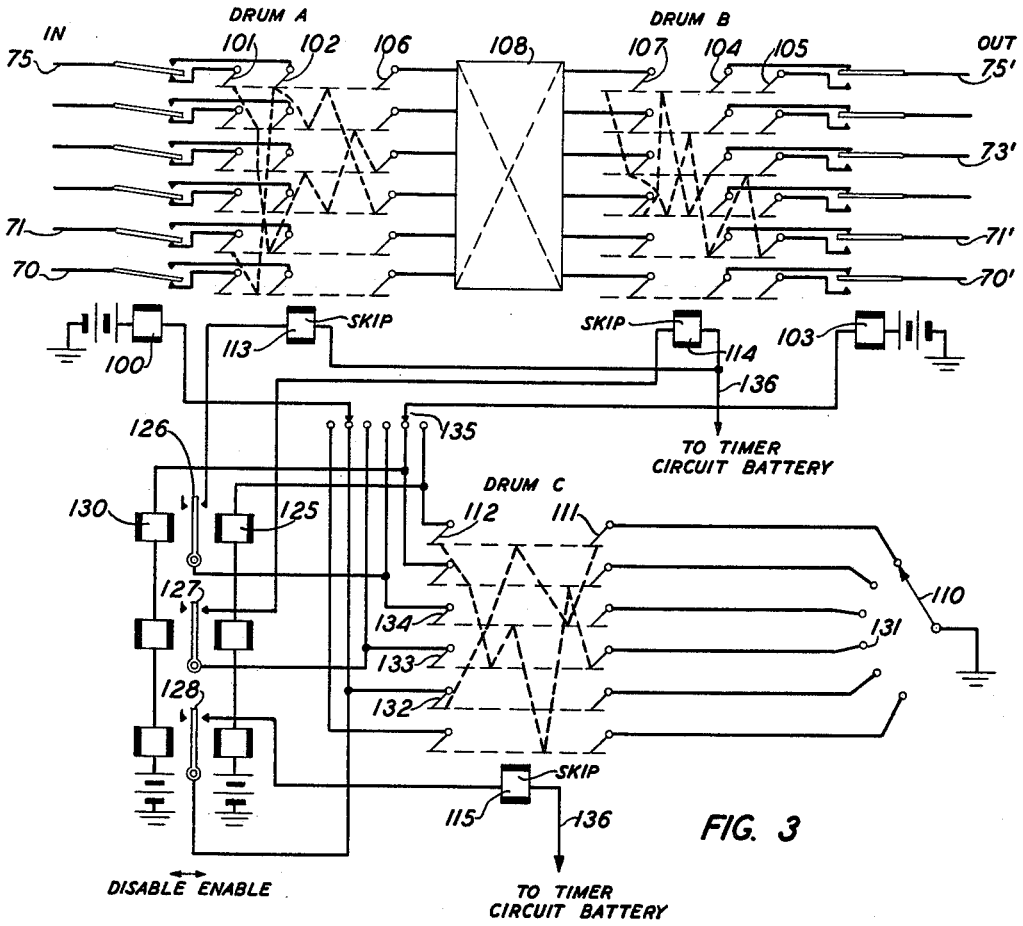
FIG. 3
FIG. 4
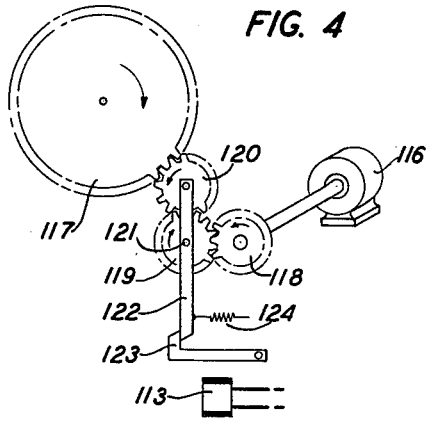

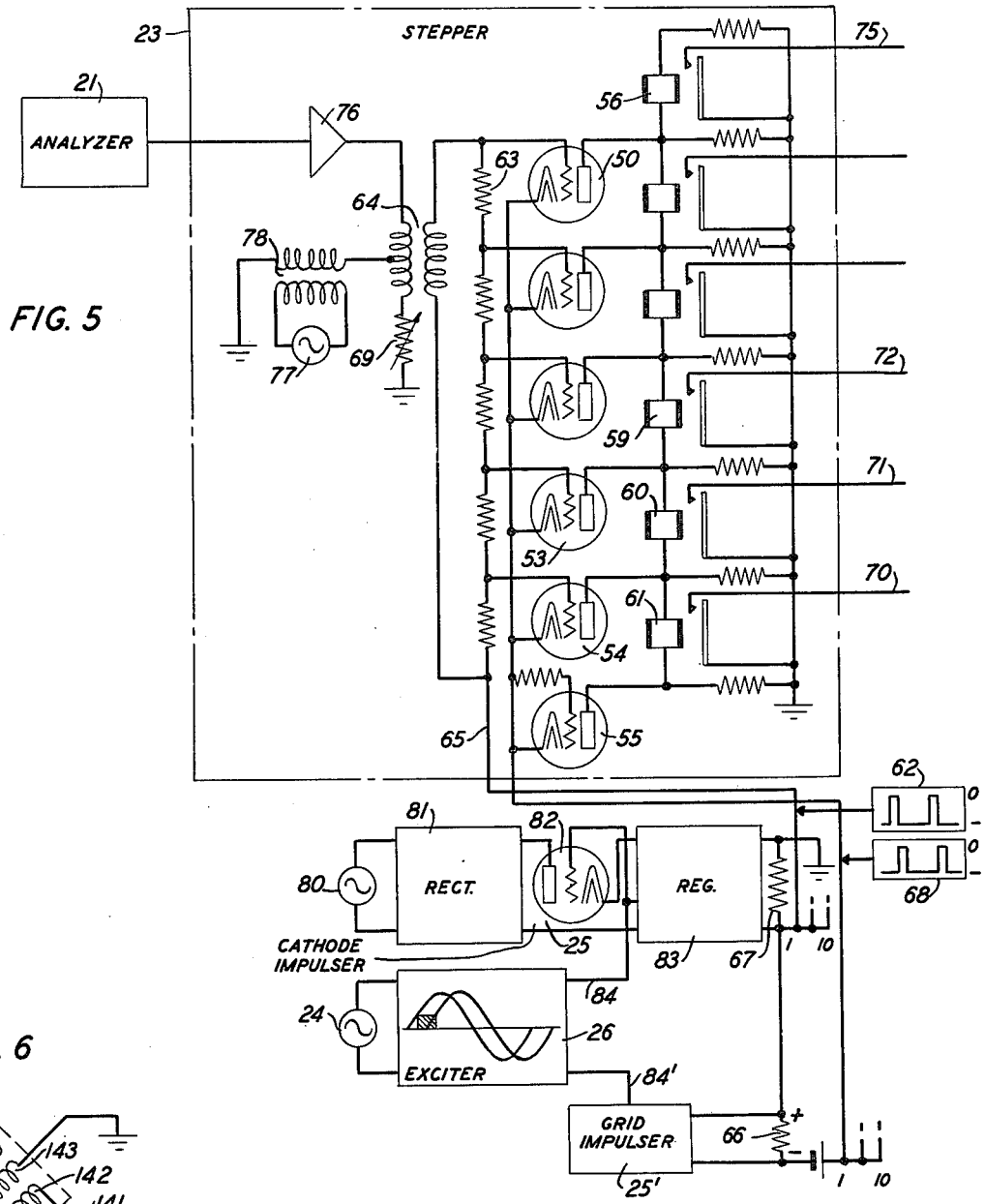
FIG. 5
FIG. 6
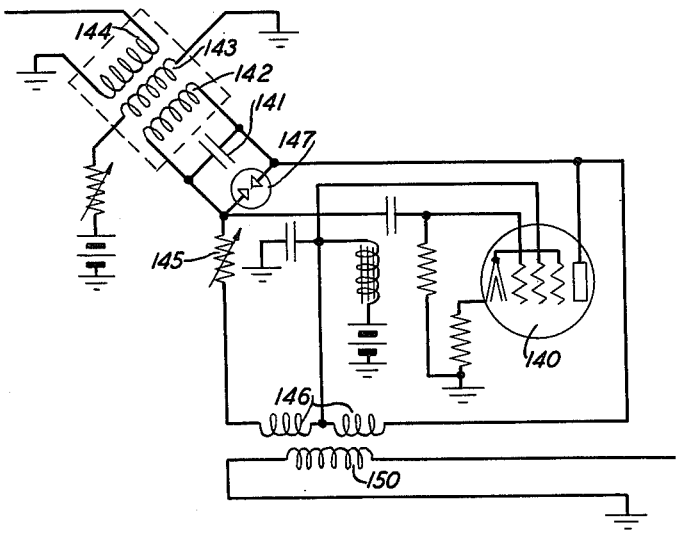

SIGNALING SYSTEM

The present invention relates to secret signaling and is adapted for speech transmission and similar uses.

In the form of the invention to be disclosed, speech waves are first analyzed to derive in a number of different circuits or channels a series of slowly varying currents indicative of the energy variations in different component frequency bands of the speech. These currents are then stepped to provide a limited number of discrete values for transmission, it being found that intelligible speech can be transmitted by the use of stepped currents even though the currents as derived from speech are continuously variable. As an example, each of these slowly varying currents can be sufficiently well represented, if only five of six distinct current values are sent. These step values are then coded to disguise their identity by providing, in accordance with this invention, a continuously operating permuter which serves to set up in its output new step values for transmission in response to the signal current steps applied to its input, in such manner that any value of input current has a substantially equal chance of setting up any value of output current for transmission. Thus, there is no perceivable relation between the input and output currents, the latter having in the ideal case a completely random distribution with time. This ideal can be sufficiently closely approached in practice to provide currents for transmission which include practically no clue to the signal or message.

In order to decode such transmitted currents, it is necessary to have at the receiver a permuter of the same type as that used at the transmitter, running in step with the transmitting permuter so as to perform the reverse process and supply output currents representing the clear signal.

One feature of the invention comprises a continuous permuter for a plurality of leads (e.g. six input leads) for connecting them to a corresponding number of output leads in different permutations in successive times in a non-repetitive order.

It will be noted that the invention in the disclosed embodiment achieves a random or near random distribution in the line current values and is able to do this without the use of a random key, by use of the process of distributing the input signal values with equal probability over a limited number of output current values, as by switching the controls between input and output current values.

The general object is to secure substantially complete secrecy of transmission of speech or similar signals by redistributing the signal values to provide substantially randomly varying currents for transmission.

Related objects and the various features of the invention will be more clearly understood from the following detailed description of the illustrative embodiment shown on the attached drawings:

In the drawing,

FIGS. 1 and 2, when placed together with FIG. 1 above FIG. 2 as shown in the key FIG. 7, show in schematic circuit diagram one complete two-way speech terminal incorporating the invention;

FIG. 3 is a diagrammatic showing of the permuter drums and control circuit;

FIG. 4 shows a mechanical detail in the drive for the permuter drums;

FIG. 5 is a schematic circuit diagram of the steppers and their control circuits; and FIG. 6 is a schematic circuit diagram of a type of frequency modulated oscillator that may be used in the system of FIG. 1.

Figures 1, 7:
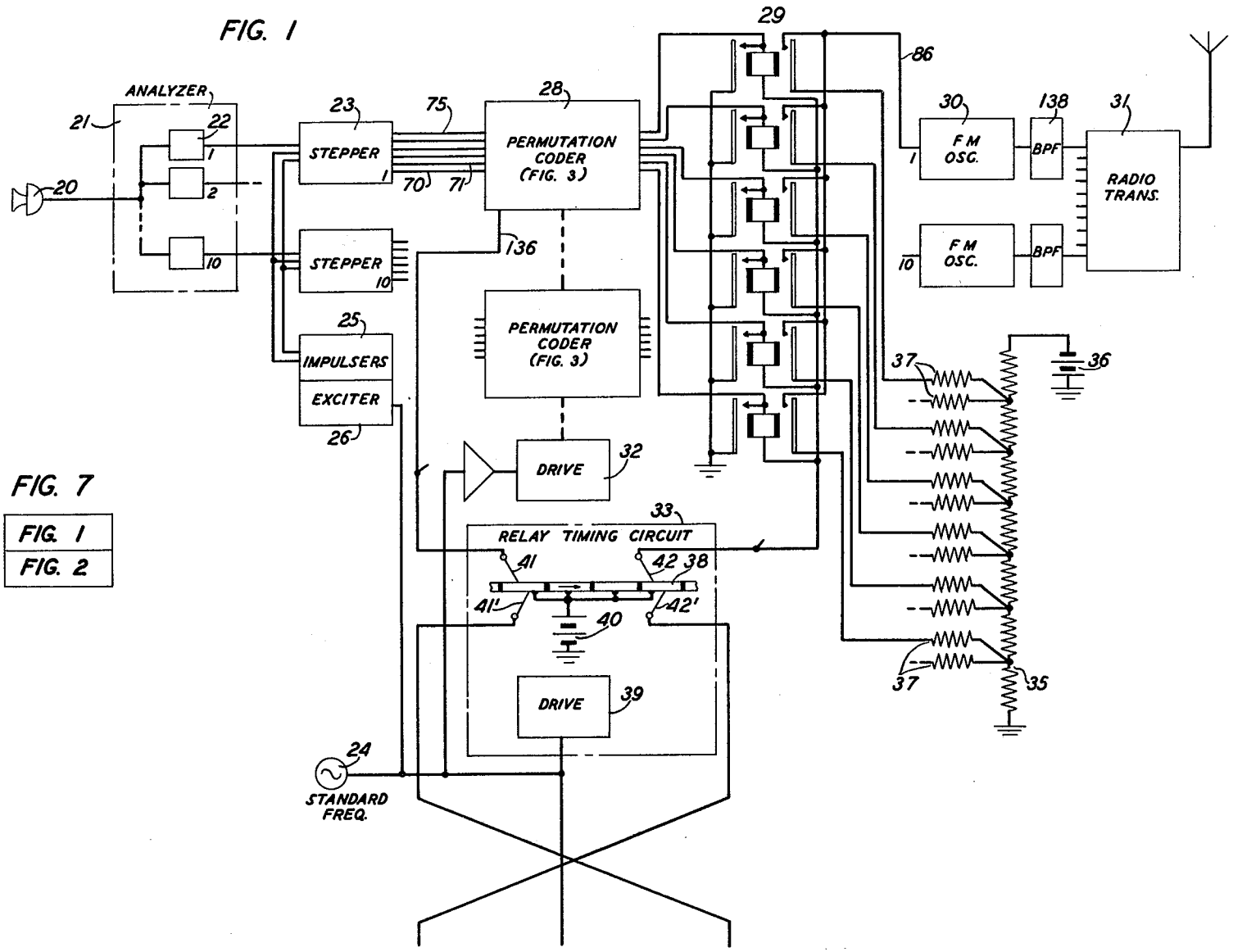
Figure 2:
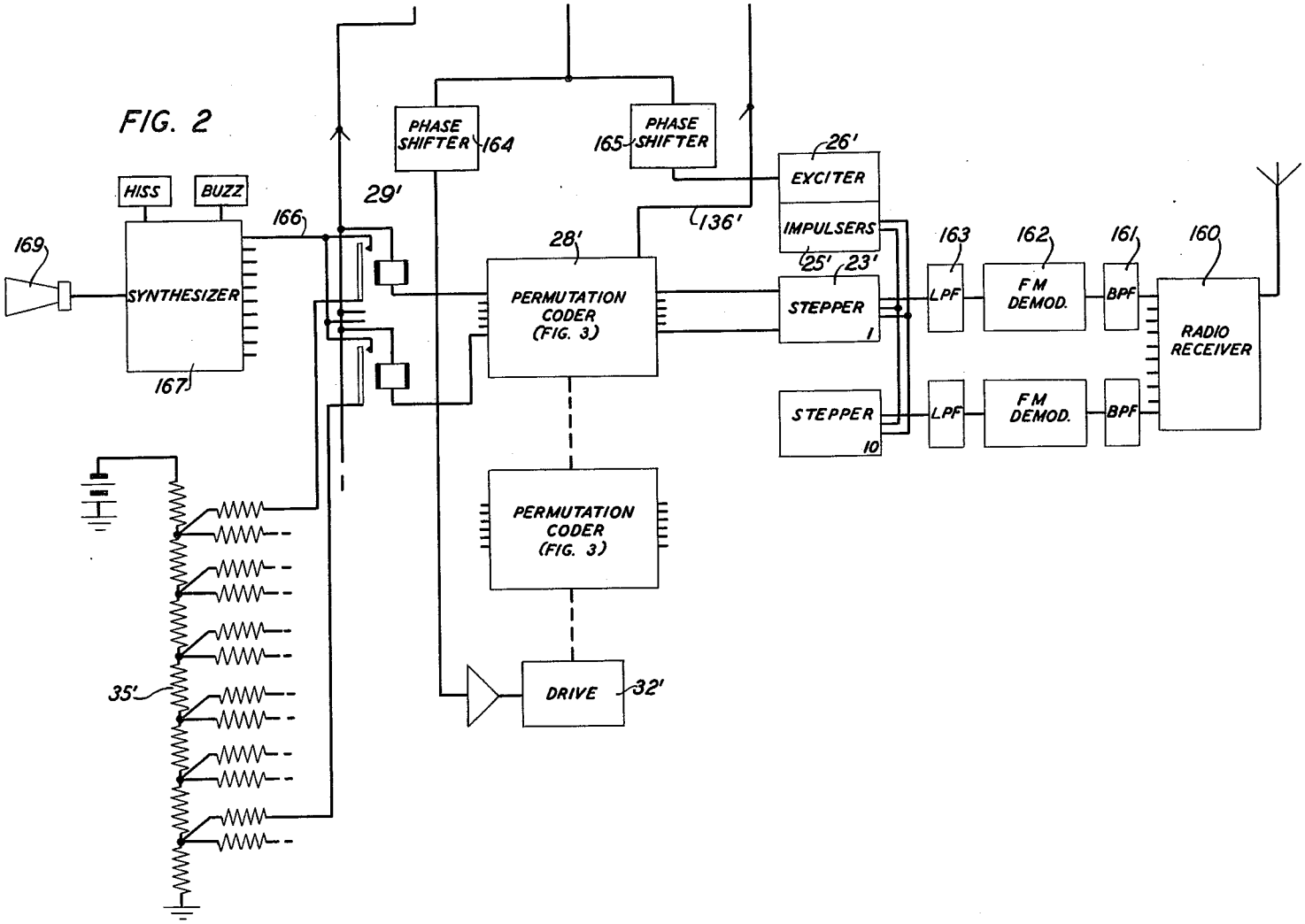

Referring first to FIG. 1, this figure shows the transmitting side of the two-way station disclosed in FIGS. 1 and 2, the receiving side being shown in FIG. 2. Speech spoken into the transmitter 20 is analyzed in analyzer 21 into a number of component currents in separate circuits, assumed in the present disclosure to comprise ten such component currents in ten different circuits. The current in each of these ten circuits or channels is separately coded or enciphered and then the ten coded currents are recombined in the radio transmitter 31 for transmission to the distant point.

The analyzer 21 comprises ten band-pass filters for subdividing the speech band into subbands and each branch includes not only the subdividing filter but an integrating circuit such as a detector or rectifier followed by a low-pass filter having a pass range up to about 25 cycles. These pieces of apparatus are assumed to be included in the block 22 and in a similar block in each of the ten channels of the analyzer. One of the channels is devoted to deriving the fundamental or vocal cord pitch, the other nine channels being used for deriving currents representing the spectrum distribution of energy over the utilized band. For a complete disclosure of the analyzer and its method of operation, reference may be had to U.S. Pat. No. 2,151,091 to H. W. Dudley, granted Mar. 21, 1939.

It is the function of the steppers 23, of which one per channel is used, to sample the low frequency currents in the component channels periodically and to operate one of six relays (shown in FIG. 5) in accordance with the strength of the component current at the instant of sampling. It is assumed in the present disclosure that satisfactory transmission can be obtained by transmitting only six different values, including zero value, of amplitude of the component currents and, as already stated, a different one of the six relays is operated for each of the six values of current to be transmitted. The detailed circuits of the steppers 23 will be described later in connection with FIG. 5.

The times at which the component currents are sampled by the steppers 23, as well as the timing of the rest of the apparatus at this terminal, is controlled from a standard frequency oscillator 24, assumed to be designed in accordance with known practice to have a high degree of constancy of output frequency. By way of example, the frequency generated at 24 may be 50 cycles per second. Some of this current is supplied to exciter 26 for in turn controlling impulsers 25 for timing the operation of the steppers 23 in the manner to be indicated more fully in connection with FIG. 5.

When any one of the six relays referred to is operated it applies ground over one of six input conductors 70 to 75 to the input side of the permutation coder 28. There is one of these coders for each of the ten channels. The action of the permutation coder is to extend the ground applied to its input to different ones of the six relays 29, on its output side and to do this in a very haphazard and unsystematic manner so that ground on any given input lead 70 to 75 has a substantially even chance of operating any one of the six relays 29. The details of the permutation coder will be described more fully in connection with FIG. 3.

When any one of the six relays 29 is operated, it attracts its left-hand and also its right-hand armature. The left-hand armature substitutes a locking ground for the ground supplied by the permutation coder and the right-hand armature and contact impresses one of six direct current voltages obtained from the potentiometer 35 to the input of the frequency modulated oscillator 30 of that channel to cause a different frequency to be applied to the radio transmitter 31 for each of the six relays in the group 29. Potentiometer 35 has a constant voltage impressed on it from battery 36 and is common to the frequency modulated oscillators of all ten channels. Isolating resistances in the several leads are shown at 37. The details of the frequency modulated oscillators will be given later on in connection with FIG. 7.

A common timing circuit 33 controls the timing of the relay 29 of all channels and certain switching functions in the permutation coders. This timing circuit is indicated as comprising a rotary distributor or commutator shown in developed form at 38 and a drive 39 for the rotor of the distributor. This drive may comprise a synchronous motor obtaining its driving current from standard frequency source 24 through the medium of amplifiers, if necessary. All segments of the distributor are connected to grounded battery 40 so that the various brushes are supplied with battery voltage whenever they are in contact with one of the distributor segments. The commutator speed is such that battery is applied to a brush for about 16 milliseconds and is interrupted for 4 milliseconds. The two intervals together make up a 20-millisecond period which corresponds to fifty periods per second. In the manner to be described presently, the permutation coder applies ground to one side of the operate winding of one of the output relays 29 and the corresponding relay is actuated when brush 42 makes contact with one of the distributor segments. The substitute locking ground closed by the operation of an output relay insures that the relay remains operated for exactly 16 milliseconds under control of the commutator and brush 42, it being assumed that the permutation coder removes the ground before the end of the 16-millisecond period. This arrangement places less restriction upon the construction of the contact closing devices of the permutation coder. Brush 41 controls the operation of certain relays within the coders, to be described in connection with FIG. 3. All ten of these coders for the individual channels are provided with a common drive located at 32 which is in the form of a synchronous motor actuated from the standard frequency source 24 through the medium of suitable power amplifiers as may be found necessary.

Reference will now be made to FIG. 5 which shows one form which each of the steppers 23 may take and also shows the manner in which the stepper is controlled from the impulsers and exciter. The stepper is shown as comprising six gas-filled tubes 50 to 55 and six relays 56 to 61. The anode of each tube is connected through a resistance to ground. Winding of relay 56 is connected in series between the plate of tube 50 and the plate resistance. All of the other relays 57 to 61 have their windings directly connected across the plates of two adjacent tubes, respectively. The plate voltage for all of the tubes is supplied in the form of a negative pulse to the cathodes of all six tubes in parallel from the cathode impulser shown. The character of this current is shown in the diagram 62 which indicates that a negative voltage of 150 volts is applied to the cathodes for about 18 milliseconds and is interrupted for 2 milliseconds. The grids of the tubes 50 to 54 are connected to points in a potentiometer resistance 63 across secondary winding of transformer 64, the lower terminal of the resistance and secondary winding being connected over lead 65 to the grid impulser resistor 66, the opposite terminal of which connects to the ungrounded end of resistor 67 of the cathode impulser. The character of this voltage applied to lead 65 is indicated in the diagram 68 where the voltage is given with reference to the cathode potential. It is seen that the grid bias has a high negative value for about 18 milliseconds but is raised to approximately the cathode potential for a period of about 2 milliseconds, these 2-millisecond intervals coming immediately after the 2-millisecond intervals indicated in the diagram 62 for the interruption times of the cathode supply voltage. The effect of applying these two types of voltage pulsations to the cathode and grid bias leads is that the tubes 50 to 54 have their grid circuits exposed for 2 milliseconds to whatever signal voltage may be existing at the time across the potentiometer resistance 63 so as to allow one or more of the tubes 50 to 54 to break down, depending upon the strength of the signal current in potentiometer 63. At the end of this short exposure period the grid voltage of all of the tubes 50 to 54 is thrown to a high negative value with respect to the cathodes. Whatever tubes have broken down remain in the conducting condition as long as the −150 volts is applied to the cathodes. When this voltage is interrupted all tubes restore to the non-conducting condition for a 2-millisecond interval after which the negative voltage is reapplied to all of the cathodes and an exposure bias is again applied to the grids for resampling the signal current. It will be observed that the grid of tube 55 is permanently connected to its own cathode so that this tube breaks down on every application to its cathode of the −150 volt pulse. Any one or more of the tubes 50 to 54 or none of them may break down, depending upon whether the signal current in resistance 63 has sufficient strength to raise the grid potential to the ignition value.

As already noted, if the impressed signal current has zero signal value, only tube 55 breaks down for about 18 milliseconds out of each succeeding 20-millisecond period. Space current through tube 55 causes actuation of relay 61, if tube 54 is not fired. Zero signal, therefore, repeatedly applies ground to input conductor 70 leading to the permutation coder. If the signal, instead of having zero value at the sampling time, has a value greater than one but less than two units, tubes 54 and 55 both fire, preventing operation of relay 61 but causing operation of relay 60. For a signal current of this value, therefore, ground is applied to conductor 71. Similarly, if the signal value at the time of sampling is greater than two units but less than three units, tubes 53, 54 and 55 fire, causing relay 59 to operate but preventing operation of relays 60 and 61. Ground is thus applied to conductor 72. If the signal strength is five units or greater, all tubes fire and relay 56 only is actuated, placing ground on conductor 75.

In order to apply the signal current which consists of variable direct current to the stepper tubes, an amplifier 76 is provided the plate circuit of which is energized from an alternating current source 77 through transformer 78. This source may have any convenient or suitable frequency, such as 2 kilocycles per second. Accordingly, there is transmitted through the output transformer 64 an alternating current having a frequency of 2 kilocycles per second, the peak amplitude of which varies directly in accordance with the magnitude of the signaling current in the particular vocoder channel from the analyzer 21. The circuit is balanced by resistor 69 so that for zero signal input no voltage is produced in the secondary winding of transformer 64.

Referring to the exciter 26, this may comprise pairs of vacuum tubes the grid circuits of which have impressed upon them some of the standard frequency wave from source 24. Included between source 24 and the grid circuit of each tube is a phase shifter, not shown, for advancing by a controllable amount the phase of the voltage that is applied to the grid of the individual tube. The tubes are individually biased so as not to transmit current during the negative swing of the applied wave and to begin to transmit current only after a positive voltage of a certain value is applied to the corresponding grid. One of the tubes of each pair will, therefore, start the transmit current somewhat in advance of the other tube of the pair, depending upon the phase difference between the waves applied to their grids. The arrangement is such that as soon as plate current begins to flow through the second tube of the pair, this current interrupts current flow in the first tube of the pair, as by sending current through a resistance in the grid circuit of the first tube. The first tube, therefore, has plate current flow of a definite duration dependent upon the phase difference between the waves applied to the grids of the two tubes of the pair, this being indicated by the shaded rectangular pulse shown at the initial part of the positive half waves indicated in the box 26. One pair of exciter tubes determines the length of the pulse applied over lead 84 to the cathode impulser 25 while a second pair of tubes determines the length of the pulse applied over lead 84' to the grid impulser 25'.

Referring to the cathode impulser 25, a power source 80 supplies alternating current to rectifier 81 and the rectified output is transmitted through regulator tube 82 to the output resistor 67. A voltage regulator control tube 83 measures the voltage across resistor 67 and applies a regulating voltage to the grid of tube 82 such as to maintain the voltage across resistor 67 constant at all times when current is flowing in resistor 67. Whenever a pulse is applied from the exciter to the grid of the tube 82 over lead 84 it drives the grid of the tube 82 so far negative as to interrupt current flow through tube 82, thus momentarily interrupting current flow through resistor 67. In this manner current through resistor 67 is maintained at constant value for 18 milliseconds and is interrupted for 2 milliseconds in each of the 20-millisecond periods.

In an entirely analogous manner the grid impulser 25' maintains a constant current through resistance 66 for all except 2 milliseconds out of each 20-millisecond period and this current through resistor 66 is interrupted for the remaining 2 milliseconds. If desired, a grid bias battery or other constant voltage source may be used in conjunction with resistor 66 to supply a small residual voltage to the conductor 65 when the current through resistor 66 is interrupted so as to provide the most favorable sampling bias on the grids. The cathode impulser 25 and grid impulser 25' are common to the steppers of all ten channels. The stepper 23, impulsers 25 and 25' and exciter 26 forms no part of the present invention but represent the invention of Lundstrom and Schimpf and reference may be made to their copending application Ser. No. 456,322, filed Aug. 27, 1942 for a fuller description of the circuits. However, the use of relays, such as 56 to 61, and the manner of their connection to the stepper tubes to provide for placing a marking potential on individual output leads in accordance with the strength of the impressed signal current is the invention of the present applicant and forms a part of the subject-matter intended to be protected herein.

The permutation coder will now be described with particular reference to FIG. 3. This comprises in the form shown three rotating drums A, B and C, all of them being driven continuously from the same motor (shown in FIG. 4) except as the continuous drive may be modified from time to time in a manner to be described. Each drum is composed of insulating material having conductive segments in its periphery over which sets of brushes ride. The drums are shown in developed form in the drawing, there being indicated in each case six horizontal rows of conducting segments. In practice, the number of segments in any one circumferential row would be much greater than those shown in this figure, although the principle of operation remains the same. The six input leads 70 to 75 are shown at the left as being connected to individual armatures of relay 100. When relay 100 is operated (as shown), these armatures connect the incoming leads to a first set of six brushes shown at 101 and when relay 100 is deenergized, its armatures transfer these six leads to a second set of six brushes shown at 102. In a corresponding manner the output leads shown at 70' to 75' are connected to armatures of relay 103 by means of which the leads may be connected to either a first set of six brushes 104 or a second set of six brushes 105.

In the case of each drum, conducting segments in each vertical row are permanently connected to the segments of the next vertical row, the connections being made in permutations of six from row to row throughout, the permutation being either cyclic or non-cyclic as desired. Only two connections are carried through in the drawing by way of example, these being indicated by dotted lines. The user will ordinarily choose to adopt his own scheme of interconnection and to maintain this scheme of interconnection secret. A set of six output brushes 106 on drum A connects to a set of six input brushes 107 on drum B through the medium of an interconnecting panel 108 which permits the six leads to be cross-permuted from time to time in any manner desired.

From the description that has been given of drums A and B, it is seen that a conductive connection is carried through from each input lead 70 . . . 75 to some one output lead 70' . . . 75' by means of the brushes and permanent interconnections between distributor segments. For example, lead 75 is shown connected to the uppermost brush 101 resting on a distributor segment in the uppermost row, this segment being connected through the permanent interconnections within the drum to the third output brush 106, counting down from the top. Supposing for the moment that the conductors go straight across the panel 108, this brush is connected to the third brush of set 107, counting down from the top, and this brush is connected by way of the segment on which it is found and by way of permanent connections within drum B to the second from lowermost output brush 104 and thence to output lead 71'. If a ground is on input lead 75, this ground emerges on output lead 71'. For further illustration, if the ground has been applied to input lead 71 it is found upon tracing through in like manner that it emerges on output lead 73'.

The function of drum C is to make the motions of A and B irregular and also to add other types of irregularities so as to destroy periodicity. A switch 110 indicative of any suitable manner of control whose position can be changed from time to time, applies ground when set as shown, to the input brush 111 of drum C and this ground emerges on one of the six leads connected to brushes 112 at the left. This ground is shown as performing various functions to introduce irregularity in the drums A and B. For example, either the relay 100 or relay 103 may be actuated by application of ground from the corresponding brush 112 to shift the input or output leads of drums A and B from one set of brushes to the other. Also, one of three magnets 113, 114, 115 for the respective drums A, B and C may be energized to cause the corresponding drum to skip one step.

The mechanism for causing the skipping of one step is shown diagrammatically in FIG. 4. The driving motor 116 drives drum pinion 117 through a train of three gears 118, 119, 120. The shaft of gear 119 is mounted in suitable bearings on the same frame as the drum bearings so as to remain at a fixed distance from the shaft of the drum. Lever 122 is free to rotate about the shaft 121 and move gear 120 toward or away from gear 117. When the skip magnet 113 is deenergized its latch 123 prevents the lower end of lever 122 from moving to the left and so holds pinion 120 engaged with gear 117. If the magnet 113 is momentarily energized and then released, the resistance to motion of the gear 117 forces pinion 120 to move to the right, that is, to ride over one of the teeth on gear 117 but the tension on spring 124 is enough to cause the pinion 120 to reengage the next tooth on gear 117. If at this time magnet 113 is deenergized so that its armature 123 catches the lower end of lever 122, pinion 120 again imparts motion to gear 117. In this manner the gear 117 and its corresponding drum may be allowed to skip one or more teeth, depending upon the time of energization of magnet 113.

One manner in which drum C can control the skip magnets 113, 114 or 115 is indicated by way of illustration. Enabling magnets 125, when energized, throw their armatures 126, 127 and 128 to the right in the figure where they remain against the corresponding contacts until disabling magnets 130 are energized and throw these armatures over to their left-hand position. Whenever ground from switch 110 emerges on brush 112, it will energize enabling magnets 125, thus preparing energizing circuits for all three skip magnets 113, 114 and 115. If in any succeeding time interval a ground should emerge from switch 110 through the drum C to brush 132, this ground would be carried over armature and contact 128 to the winding of skip magnet 115 and thence to a brush on the timer circuit 33, causing the momentary energization of magnet 115. In a similar manner, by application of ground to brush 133 or 134, circuits can be prepared for causing energization of magnet 114 or magnet 113, respectively.

From the description that has been given of the drum C, it will be obvious that many variations and irregularities can be introduced at will. For example, the movement of the contact arm 110 over the arc of six contacts may be carried out in any desired manner either manually, that is, changed from time to time or more rapidly by an irregular type of control, such as a punched tape or the like. The energizing circuits for relays 100 and 103 are indicated as carried to movable contacts on six terminals 135 connected to the six output brushes of drum C. The position of these contacts may be shifted from time to time. Other alterations may be made in the connections at will, it being only necessary that whatever changes are introduced at one station be simultaneously made at the distant station in accordance with a prearranged schedule. It will be obvious in view of drums A and B to supply plural sets of brushes for drum C and to provide switching relays for connecting the output leads to any set of brushes.

Considerable tolerance exists in the cutting of the segments for the drums A, B and C. For example, referring to the circuit of FIG. 1, it is only necessary that the brushes on the drums A and B be positioned on corresponding vertical rows of segments at the time the relays 56 to 61 are energized at the beginning of their energizing period and that the brushes have passed off these vertical rows of segments and on to the next succeeding rows of segments by the time these relays again become energized.

While in the specific circuit disclosed herein the permutation coder closes only one circuit at a time from an input to an output circuit it will be noted that all six input brushes are always connected to all six output brushes in an ever changing order and that the coder can equally well serve for interchanging six input circuits with six output circuits, there being no limitation, of course, to the number six.

Reference is now made to the frequency modulator circuit of FIG. 6. This comprises a known type of vacuum tube oscillator comprising a pentode tube 140 the tuning circuit of which comprises a capacity 141 and an inductance 142, the latter of which is mounted on a core together with windings 143 and 144. The type of oscillator circuit is a so-called bridge type in which the tuned circuit 141, 142 comprises one arm of the bridge, the other arms being comprised of balancing resistor 145 and a respective half of the primary output winding 146. Peak limiting tube 147 is used to provide constant peak amplitude. The winding 143 is a regulating winding for setting the mean frequency. As different values of direct current are applied to the control winding 144 the saturation of the common core is varied, thus varying the inductance of winding 142 and changing the frequency of oscillation of the circuit. The output frequency may be taken from across secondary winding 150. Suitable frequencies of oscillations are from about 500 cycles to 3,000 cycles per second and each step of voltage applied from potentiometer resistance 35 (FIG. 1) may be such as to shift the oscillation frequency by the order of 50 or 100 cycles, by way of example. A fuller disclosure of this type of frequency-modulated oscillator is given in the Lundstrom-Schimpf application cited above.

The operation of the circuit of FIG. 1 will now be described. As a result of the action of the analyzer 21 on impressed speech waves slowly varying direct currents flow in one or more of the analyzer channels. The steppers in the individual channels, in effect, measure the strength of such currents at definitely timed instants and operate one of six relays 56 to 61 corresponding to each different current strength. The coder output relays 29 operate one at a time in successive instants to set up in the common input branch 86 of the frequency modulating circuit 30 various ones of six different direct current voltages obtained from potentiometer 35. The permutation coder 28 operates in response to the grounding of each of its input leads in succession to operate any one of the six output relays 29 with substantially equal probability so that the value of the current at any instant in lead 86 gives no clue to the signal current but varies in substantially random manner with time. These direct current voltages impressed on oscillator 30 shift its frequency by definite amounts in steps, each new frequency enduring for an interval of about 18 milliseconds. This same action occurs simultaneously in each of the ten channels and the ten independently varying frequencies are applied through channel band-pass filters 138 to the radio transmitter in a manner similar to that used in multiplex carrier transmission. The radio transmission may make use of any standard type of operation, such as amplitude modulation or frequency modulation for simultaneously modulating a radio frequency wave in accordance with the group of frequency modulated waves from modulators 30.

The manner in which these transmitted currents are received at the distant station and are decoded and used to reproduce the speech message may be seen from a consideration of the receiving side of the terminal station shown in FIGS. 1 and 2, the receiving side being shown in FIG. 2.

The radio frequency waves modulated by the coded impulses from the distant station are received in radio receiver 160 and the various individual channels are separated by selecting filters 161. Each channel includes a frequency modulation demodulator 162 for recovering the direct current pulses used to modulate the frequency of the various channel oscillators at the distant station. These impulses are passed through a low-pass filter 163 and impressed upon the steppers of which there are one for each of the ten channels. Considering the stepper 23' for channel 1, this is a duplicate of stepper 23 of FIG. 1. It is caused to sample each of the received coded pulses at the center part of the pulse due to the application of timing waves to its grids and cathodes from the impulsers 25', under control of exciter 26' supplied with some of the standard frequency oscillation from source 24 by way of a phase shifter 165. This phase shifter introduces sufficient phase delay into the standard frequency control waves supplied to the receiver steppers to compensate for transmission delay in the path from the distant station, assuming that the control oscillator 24 at the distant terminal is running in synchronism and in phase with the oscillator 24 of FIG. 1. In each sampling time of stepper 23' some one of the stepper relays will be operated depending upon the amplitude of the sampled pulse.

The permuter coder 28' is a duplicate of the permuter coder 28 of the distant station and operates in step with it but in the case of coder 28' the input and output leads are reversed with respect to coder 28 of the distant station. That is, referring to FIG. 3, the stepper relays of FIG. 2 place grounds upon the conductors 70' to 75' and the output relays 29' of FIG. 2 are operated by grounds supplied from leads 70 to 75 of FIG. 3, assuming that the coder of the distant transmitting station operated as above described with respect to FIG. 3. Relays 29' are timed from brush 42' of FIG. 1 and coder 28' has its switching functions timed from brush 41'. These brushes lag behind brushes 41 and 42 to compensate for path delay. The drive 32' for the permutation coders of FIG. 2 obtains its control wave from the standard frequency source 24 by way of a phase shifter 164 which includes enough phase delay to compensate for transmission path delay.

As a result of the operation of permutation coder 28' some one of the relays 29' will be operated in each sampling period and the relay so operated will correspond to the stepper relay that was operated at the distant transmitting station. The operated relay 29', therefore, gives a measure in each sampling period of the input signal value existing in the output of stepper 23 of the distant station. Relays 29' apply direct current voltages in steps from potentiometer 35' to the uppermost lead 166 leading to the synthesizer 167. These steps correspond in value to the steps into which stepper 23 at the distant station divided the signal amplitude. The ten channels leading to the synthesizer 167 are in similar manner supplied with decoded pulses representing the original currents in the ten analyzer channels at the distant station.

The synthesizer 167 may be of the same type as disclosed in the Dudley patent above cited for reconstructing understandable speech under control of the varying direct currents in its ten control channels. This synthesizer is provided with a source of currents representing vocal cord energy (buzz) and a source of continuous spectrum currents such as resistance noise (hiss) out of which the speech sounds are reproduced by proper selection and control. One of the channels is used for pitch control and the other nine channels are used for spectrum control in the manner disclosed more fully in the Dudley patent. The outputs of all nine spectrum control channels are suitably combined in a common output circuit leading to the telephone receiver or speech reproducer 169 which may be a telephone line or other speech receiving medium.

What is claimed is:

1. In electrical signaling in which the signal varies in amplitude from instant to instant, and at any one instant has an amplitude equal to one of a limited number of values having a total range in excess of two, means to disguise the signal preparatory to transmission comprising means in each instant to establish for transmission under control of said signal a voltage having with substantially equal probability any one of a like limited number of amplitude values having a total range in excess of two, means to transmit said established voltages, and means at a receiving point to retranslate the transmitted voltages into the clear signal.

2. In a speech privacy transmission system, means to derive from speech message waves index currents varying in value from instant to instant and having a total range of values in excess of two, a privacy device including means to establish an output current varying in discrete steps from instant to instant and having a total range of steps in excess of two, means to impress said index currents on said privacy device, and means in said privacy device operating in response to impressed index currents of any given value to select and establish an output current having any one of said discrete step values with substantially equal probability.

3. In an enciphering system for signal currents, a stepper circuit comprising a set of more than two marginally operated relays operative one at a time in accordance with a respective instantaneous magnitude of the signal current, timing means to cause said stepper to operate at intervals to actuate a respective relay in accordance with the signal current magnitude in each interval, a set of relays equal in number to the stepper relays and operable one at a time under control of the relays in said stepper, said relays of said set controlling output current magnitude in steps equal in number to that of the relays of the second-mentioned set and dependent upon which relay of the second-mentioned set is operated, and enciphering means comprising a number of control paths between said sets of relays limited to the number of relays in each set and operable in each interval to provide on a substantially random basis a single control path only between one only of said stepper relays and one only of said second-mentioned set relays, whereby in each interval the output current magnitude has any one of the several step values irrespective of the instantaneous magnitude of signal current.

4. In a signaling system, means for interconnecting a plurality of input conductors in various orders to an equal number of output conductors in successive times on a permutation basis, comprising a plurality of drums arranged in series each having circumferential rows of separated contacts, one such row per input conductor, a first input brush per row, and a first output brush per row, the initial drum of said series including a second input brush per row located intermediate said first input brush and said first output brush of said initial drum, the final drum of said series including a second output brush per row located intermediate the first input brush and the first output brush of said final drum, means to move the drums relative to the brushes, means interconnecting the output brushes of one drum to the input brushes of the next drum, means for intermittently advancing one drum relatively to another, means for transferring at intermittent times said input conductors from one set to the other of the first input brushes and the second input brushes of said initial drum and said output conductors from one set to the other of the first output brushes and the second output brushes of said final drum, and fixed connections between the contacts of each row and the contacts of each other row within the same drum such that upon each movement of the drum the distance from one contact to the next relative to the brushes a different set of conductive paths is established from the plurality of input brushes of the first drum to the plurality of output brushes of the last drum.

5. In a signaling system, a plurality of input leads more than two in number, a corresponding number of output leads, and means for simultaneously establishing a separate conductive path from each input lead to an individual output lead and for varying the order of interconnection between input and output leads in a long non-repetitive program comprising a set of input brushes and a set of output brushes individual to the input and output leads, respectively, said sets of brushes being movable over and with respect to individual rows of separated contacts on the peripheries of different respective drums, each contact of each row on the same drum being cross-connected to a contact of each other row on a permutation basis, a second set of input brushes movable over and with respect to the individual rows of the separated contacts but spaced one or more contacts in said rows from said first set of input brushes of the respective drum, a second set of output brushes movable over and with respect to the individual rows of the separated contacts but spaced one or more contacts in said rows from said first set of output brushes of the respective drum, other sets of brushes for connecting said drums in series relation, and means to impart irregular motion to individual drums relative to their brushes and to alternate at irregular intervals the connection of said input leads between said first and second sets of input brushes and the connection of said output leads between said first and second sets of output brushes, to prevent recurrence of the same conductive paths in successive rotations of said drums.

* * * * *